US005687705A

United States Patent [19]

Blair

[11] Patent Number: 5,687,705

[45] Date of Patent: Nov. 18, 1997

[54] ALUMINUM BASEBALL OR SOFTBALL BAT WARMER

[76] Inventor: Eddie D. Blair, 717 Nicholson Dr., Potosi, Mo. 63664

[21] Appl. No.: 691,278

[22] Filed: Aug. 1, 1996

[51] Int. Cl.[6] ..... F24C 3/00

[52] U.S. Cl. ..... 126/229; 126/226; 431/344; 431/345

[58] Field of Search ..... 126/226, 229, 126/208, 85, 404, 407, 410, 409, 412, 414, 248–252; 431/277, 344, 345, 267

[56] References Cited

U.S. PATENT DOCUMENTS

| | | | |
|---|---|---|---|
| D. 315,596 | 3/1991 | Brotheras et al. | D23/332 |
| 2,637,315 | 5/1953 | Staggs | 126/229 |
| 2,691,976 | 10/1954 | Kynard | 126/229 |
| 3,577,974 | 5/1971 | Boldt | 126/229 |
| 3,977,521 | 8/1976 | Murphy | 206/315 |
| 4,340,029 | 7/1982 | Kelly, Jr. | 126/237 |
| 4,420,681 | 12/1983 | Arnold | 219/521 |
| 5,237,912 | 8/1993 | Fins | 99/393 |
| 5,404,865 | 4/1995 | Huls | 126/206 |

*Primary Examiner*—James C. Yeung
*Attorney, Agent, or Firm*—Grace J. Fishel

[57] ABSTRACT

An aluminum baseball or softball bat warmer with an inner and outer container separated by an air space. The inner container is adapted to receive a bat and is supported inside the outer container on a hanger with an aperture. A convective thermal source is positioned below the hanger. Warmed air from the convective thermal source is directed through the aperture in the hanger and circulates through the air space, warming the sidewall of the inner container and the bat therein. By heating the aluminum bat, the possibility of cold denting and cracking thin walled aluminum bats formed of "CU-31" alloy, "C405" alloy or like, is reduced.

10 Claims, 3 Drawing Sheets

ALUMINUM BASEBALL OR SOFTBALL BAT WARMER

BACKGROUND OF THE INVENTION

1. Field of the Invention

The present invention relates to a device for warming an aluminum baseball or softball bat above ambient temperature.

2. Brief Description of the Prior Art

Aluminum bats, banned in the pros, were introduced in the 1970s and quickly became popular because they rarely break or need to be replaced. In addition to being less prone to breakage, a well struck ball will fly off an aluminum bat faster and go farther than off a wood bat. Coaches say the bigger sweet spot (or area of maximum impact) and lighter weight allow batters to connect on inside pitches, eliminating one of the best strikeout zones for pitchers. The light bats also enable hitters to catch up with fast balls that would otherwise smoke by, forcing pitchers to throw more curve balls, which can lead to arm trouble.

About five years ago "CU-31" alloy developed for use in aviation was introduced to the baseball industry, giving rise to thin walled aluminum bats that enabled hitters to swing faster and make better contact. A further advance in metal bats came about two years ago when Alcoa provided its extra-strong "C405" alloy, pioneered for use with Boeing. Very potent double-walled bats were made with "C405", stretched even more thinly, to enable hitters to swing even faster. Dramatic selling points are made about bats made of "CU-31" and "C405": In one ad, Worth, Inc. promises its Copperhead model will "make your competitors' blood run cold". Easton Sports, Inc. calls its Reflex bat its "most devastating model ever" High-end, thin-walled performance aluminum bats retail for more than $150.

One problem with performance bats is that the aluminum turns brittle in cold weather, making it easy for a player to dent or crack the thin walls of his bat if he hits a ball. For this reason, most manufacturers recommend not using a bat of this type if the temperature is below 65° F. A player on a cold day thus takes a risk if he uses his good bat that he will need to spend a considerable amount of money for a replacement, the alternative being to use a cheaper bat that does not perform as well. This is significant problem as many ball games are played at temperatures below 65° F. and the competition in amateur leagues is keen.

SUMMARY OF THE INVENTION

In view of the above, it is an object of the present invention to provide a warmer for an aluminum baseball or softball bat to minimize the risk of cold denting and cracking of it when the bat is used in games played at temperatures below 65° F. Other objects and features of the invention will be in part apparent and in part pointed out hereinafter.

In accordance with the invention, a warmer for an aluminum baseball or softball bat has an inner elongated container with a restricted bottom, a sidewall and an open top. The inner container is adapted to receive a baseball or softball bat lengthwise. The warmer also has an outer elongated container with a bottom end, a sidewall and an open top with the outer container surrounding the inner container with a space between the sidewalls of the inner and outer containers forming an air flow passage between the containers. A hanger is attached inside the outer container for mounting the inner container at its restricted end. The hanger includes an aperture and is spaced above the bottom end of the outer container forming a compartment. A convective heat source in provided in the compartment. In use, warmed air from the convective source is directed through the aperture in the hanger and circulates through the air flow passage warming the sidewall of the inner container and thereby warming the baseball or softball bat inside.

The invention summarized above comprises the constructions hereinafter described, the scope of the invention being indicated by the subjoined claims.

BRIEF DESCRIPTION OF THE DRAWINGS

In the accompanying drawings, in which two of various possible embodiments of the invention are illustrated, corresponding reference characters refer to corresponding parts throughout the several views of the drawings in which.

DETAILED DESCRIPTION OF THE INVENTION

Figure 1:
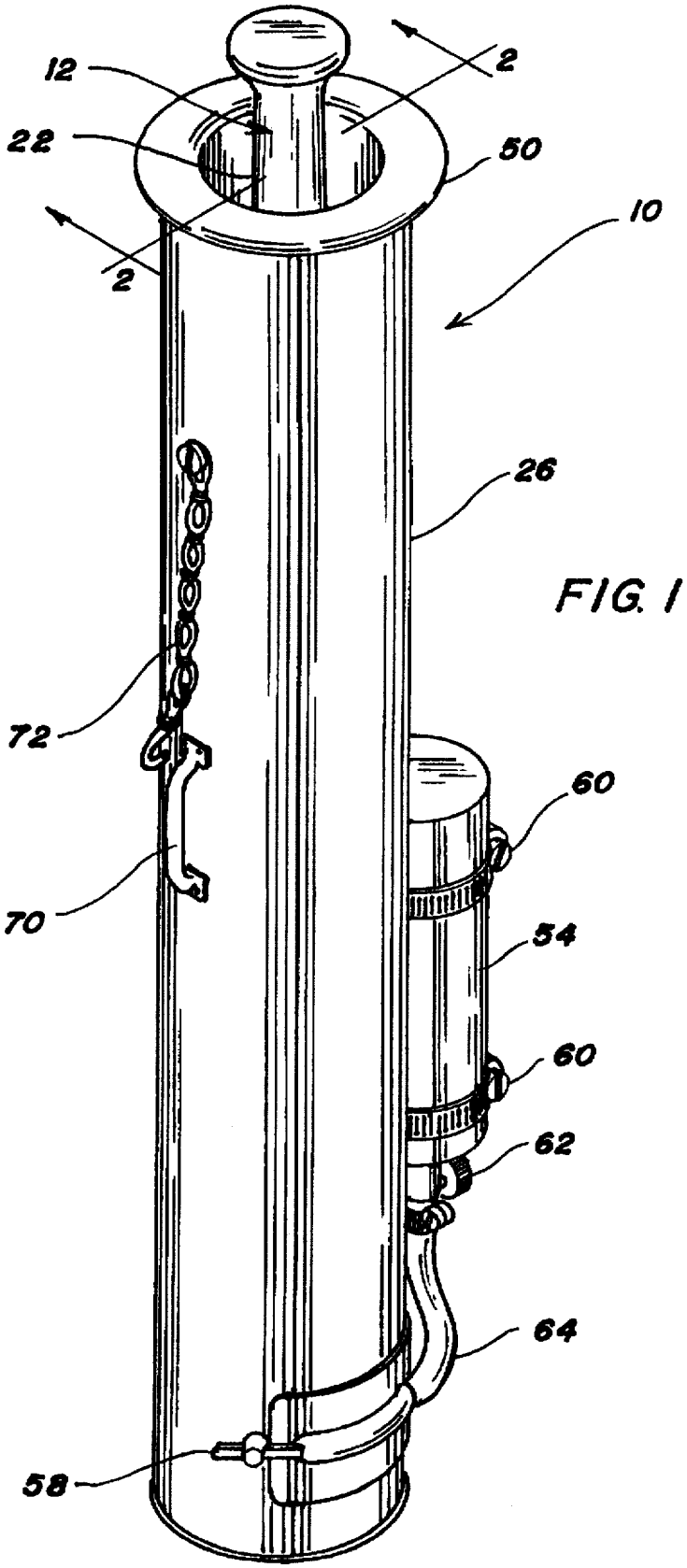
FIG. 1 is a perspective view of a bat warmer in accordance with the present invention.

Referring to the drawings more particularly by reference number, reference number 10 refers to a warmer for an aluminum baseball or softball bat 12 in accordance with the present invention, two embodiments of which are shown in the drawings. Common to both, however, warmer 10 has an inner elongated container 14 with a restricted bottom 16, a sidewall 18 and an open top 20. Inner container 14 is adapted to receive a baseball or softball bat lengthwise. The baseball or softball bat 12 has a handle 22 with a knob at one end and a hitting area terminating in a tip 24 at the other end. Bat 12 is preferably received tip end first in inner container 14.

An outer elongated container 26 has a sidewall 28 and an open top 30, said outer container 26 surrounding the inner container 14 with a space 32 between the sidewalls of the inner and outer containers forming an air flow passage between the containers. A hanger 34 with an aperture 36 is provided inside outer container 26 for mounting inner container 14. In the form illustrated in the drawings, hanger 34 necks down into a collar 38 within which an end of inner container 14 is received, thereby forming bottom 16 of inner container 14. As shown in the drawings, outer container has a closed bottom 40 and hanger 34 is spaced a distance above bottom 40 providing a compartment 42 for a convective thermal source 44.

Inner and outer containers 14, 26 may be made out of sheet metal or the like and circular in cross-section as shown in the drawings or be of some other closed geometric shape, in which form sidewall 18 and sidewall 28 may be formed from several sections. Inner container 14 may be open on the inside or, when adapted to hold several bats, may be partitioned into a plurality of separate receptacles, each adapted to hold a single bat.

As shown in the drawings, hanger 34 for inner container 14 is dished forming a downwardly depending deflector that assists in directing heated air into air space 32. Air flow is also preferably deflected initially along the inside of outer container 26 when hanger 34 is lobed and aperture 36 is formed as a plurality of holes (illustrated as four) about the periphery of the hanger. Bottom 16 of inner container 14 may be closed but is preferably slotted 46 and provided with a wad 48 of fiberglass or the like for spacing the tip end of the bat from the bottom of the inner container to moderate heat transfer to the bat. Slots 46 may be partially blocked with foil or the like to further moderate heat transfer. When slots 46 are not completely blocked, warmed air is circulated through inner container also.

In the form illustrated, inner container 14 is recessed in outer container 26 at its open end. This permits heated air to circulate around the handle end of the bat, the air by this time having transferred heat to the sidewall of the inner container and having cooled. When made of sheet metal, as shown in the drawings, the upper lip of outer container 26 may be edged with a bumper 50.

Figure 2:
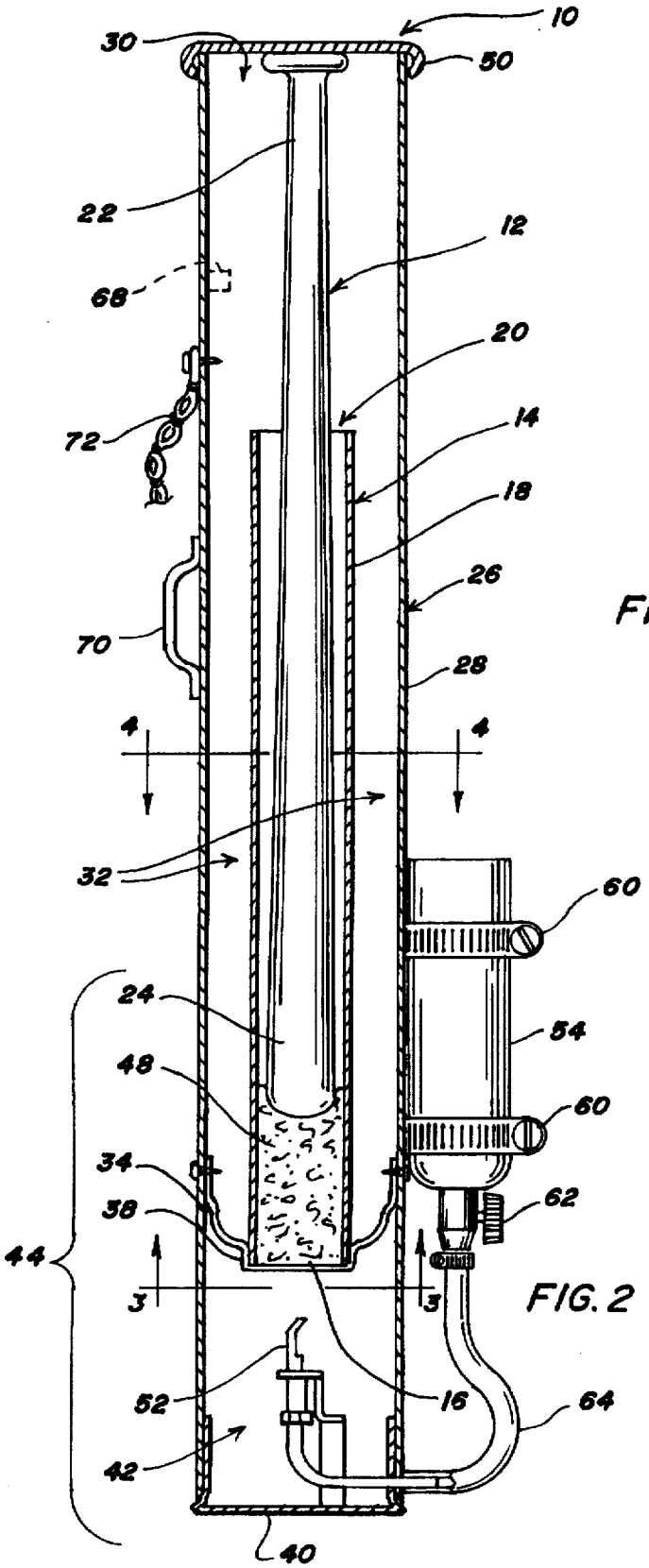
FIG. 2 is a side view in section of the bat warmer taken along line 2—2 in FIG. 1.
Figure 3:
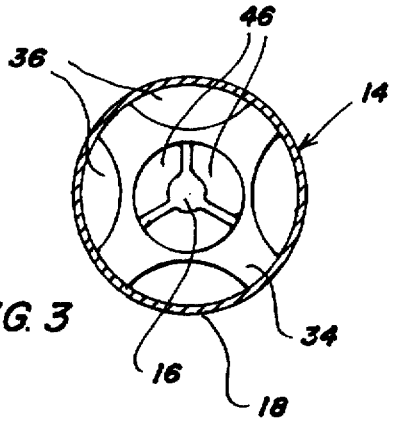
FIG. 3 is a section taken along line 3—3 in FIG. 2.
Figure 4:
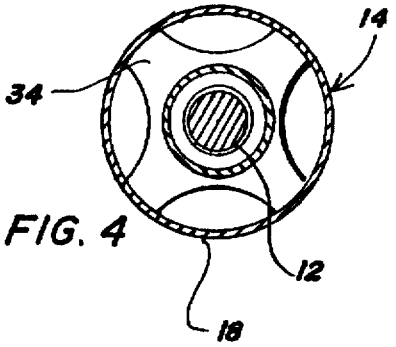
FIG. 4 is a section taken along line 4—4 in FIG. 2 with the bat and wad eliminated; and, FIG. 5 is a side view, partly in section, partly broken away, and on an enlarged scale of a second bat warmer in accordance with the present invention.
Figure 5:
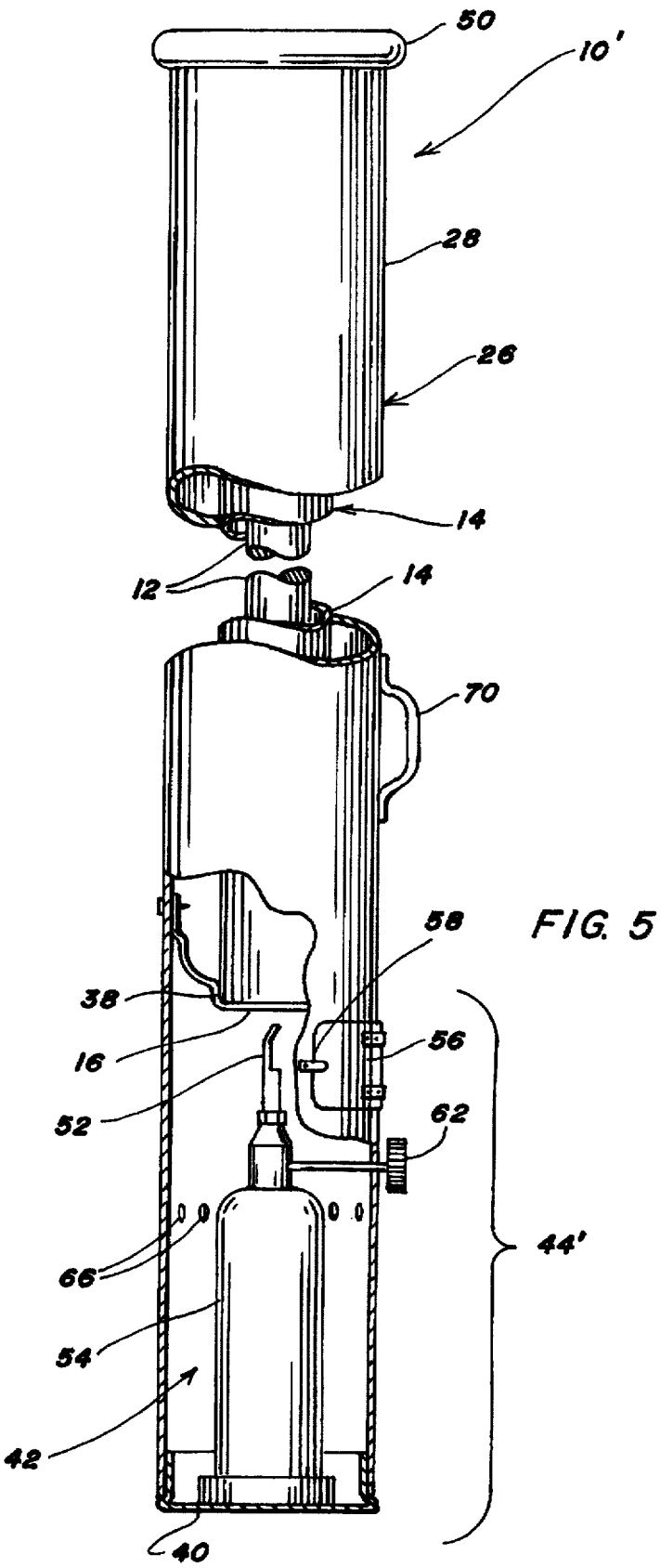

Thermal source 44 provides heat transfer largely by convection out of a combustion region or from a hot surface generated by an electrical resistance, solar collector, etc. Most typically, thermal source 44 is a burner 52 for a combustible gas such as propane. As shown in the drawings, a fuel supply 54 such as a propane cylinder is connected to burner 52 which is located under hanger 34 in compartment 42. Burner 52 is accessible through a hinged door 56 provided in sidewall 28 for that purpose. A latch 58 may be provided for keeping door 56 usually closed. Heat output from burner 52 is controlled with a valve or by restricting the orifice through which the fuel is supplied and in a preferred embodiment comprises a pilot light such as found on a residential gas water heater. Fuel supply 54 may be attached with a pair of hose clamps 60 or the like to the outside of outer container 26 as shown in FIGS. 1 and 2 or housed in the bottom of outer container 26 as shown in FIG. 4. Attachment of fuel supply 54 to the outside of outer container 26 makes the tank easily accessible to facilitate its changing, while placing the container in the bottom of outer container enhances compactness and lowers the center of gravity of the unit.

The fuel supply tank is fitted with a main shut off valve 62 as a safety measure to prevent leakage of the propane when the unit is not being used. When fuel supply 54 is attached to the outside of outer container, the main shut off valve supplies propane through a flexible hose 64 to burner 52. When fuel supply 54 is inside the outer container 26, a stem of main shut off valve 62 is elongated so that a control knob for the valve can be located on the outside of the outer container. The lower end of outer container 26 is outfitted with ventilation openings 66 to ensure a sufficient supply of air to the burner to support efficient combustion of the fuel. Igniting the thermal source 44 is initiated by opening the main shut off valve 62, inserting a lighted match through door 56 at the tip of burner 52 and opening the appropriate valve (if not controlled with an orifice) slightly until the flame is ignited. A thermostat 68 may be provided for regulating thermal source 44, in which case the upper end of outer container 26 may be capped with a lid. When outer container 26 has an open end and burner 52 is a pilot light such as found on a gas water heater, it has not been necessary to modulate the thermal source, other than to provide insulation 48 and to partially block slots 46 as described above. A tilt control may be provided for stopping the flow of fuel to the burner in case the warmer is tipped over.

Sidewall 28 of outer container 26 may be thermally insulated so that warmer 10 is not hot to touch, although this has not been found a problem to date. A thermal shield may also be provided for the fuel supply although this has not been found necessary either when the fuel supply is attached to the outside of the outer container.

A carrying handle 70 can be provided on the outside of the outer container 26 to balance the warmer with a propane cylinder attached and a bat inside the inner container and a chain 72 with a hook can be provided near the open end of the outer container for hanging the warmer on a fence.

In use, a player can hang warmer 10 on a fence, which is close to the dugout or the on-deck circle, open door 56 and light burner 52, and then slide his bat inside inner container 14, if not already in the container. In a couple of minutes, the bat will be warmed over 65° F. far enough so that it can be used without fear of cold denting or cracking, as warmed air from convective thermal source is directed through aperture 36 in hanger 34 and circulated through air flow passage 32 between the containers warming sidewall 18 of the first container. When the player is in the on-deck circle getting ready to hit, he would simply pull his bat out of the warmer and step up to the plate. While the player is at the plate, his bat would be warm and perform like it does on a warm day. This would allow the batter to hit the ball better, and he would not have to worry about cold denting or cracking of the bat. This would provide the player with increased peace-of-mind since he would not have to worry about damaging his bat and spending a considerable amount of money for a replacement. Thus a player could use his good bat on a cold day instead of resorting to a lesser quality bat. After the player hits, he would return his bat to the warmer, and it would be kept warm for the remainder of the game. At the end of the game, the player would simply turn the warmer off, and the handy carrying handle on the side would make it easy to carry the warmer with the bat inside easily. A 16 oz. capacity disposable cylinder, for example, would provide enough fuel for several games, and the bottle could be changed when it is empty.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A warmer for an aluminum baseball or softball bat comprising an inner elongated container with a restricted bottom, a sidewall and an open top, said container adapted to receive a baseball or softball bat lengthwise, an outer elongated container with a bottom end, a sidewall and an open top, said outer container surrounding the inner container with a space between the sidewalls of the inner and outer containers forming an air flow passage between said containers, a hanger attached inside the outer container for mounting the inner container at its restricted bottom, said hanger having an aperture and spaced above the bottom end of the outer container forming a compartment, and a convective heat source in the compartment whereby warmed air from the convective heat source is directed through the aperture in the hanger and circulates through the air flow passage warming the sidewall of the inner container and thereby warming a baseball or softball bat received in said inner container.

2. The warmer of claim 1 wherein an insulator is provided in the inner container for spacing the bat from the bottom of the inner container to moderate heat transfer to the bat.

3. The warmer of claim 1 wherein the inner container recessed in outer container at its open end.

4. A warmer for an aluminum baseball or softball bat comprising an inner elongated container with a restricted bottom, a sidewall and an open top, said container adapted to receive a baseball or softball bat lengthwise, an outer elongated container with a bottom end, a sidewall and an open top, said outer container surrounding the inner container with a space between the sidewalls of the inner and outer containers forming an air flow passage between said containers, a hanger attached inside the outer container for mounting the inner container at its restricted end, said hanger having an aperture and spaced above the bottom end of the outer container forming a compartment, said inner container recessed in the outer container at its open end, a burner connected to a fuel source in the compartment whereby warmed air from the burner is directed through the aperture in the hanger and circulates through the air flow passage warming the sidewall of the inner container and thereby warming a baseball or softball bat received in said inner container.

5. The warmer of claim 4 where the burner is pilot light and the fuel source is a propane cylinder.

6. The warmer of claim 5 wherein the hanger is necked down into a capped collar within which an end of the inner container is received forming the bottom of the inner container, said capped collar having slots.

7. The warmer of claim 6 wherein insulation is provided in the bottom of the inner container and wherein the slots are selected blocked to moderate heat transfer to the bat.

8. The warmer of claim 7 wherein the inner and outer containers are made of sheet metal.

9. The warmer of claim 8 wherein a handle is provided on the outer container for carrying the warmer and a chain for hanging the warmer on a fence.

10. The warmer of claim 9 wherein a thermostat is provided for controlling the pilot light.

* * * * *